US005377506A

United States Patent [19]

Tranzer

[11] Patent Number: 5,377,506

[45] Date of Patent: Jan. 3, 1995

[54] GEM SETTING

[75] Inventor: Johannes Tranzer, Koblenz, Germany

[73] Assignees: Erich Stenzhorn; Klaus Stenzhorn, both of Boppard, Germany

[21] Appl. No.: 35,646

[22] Filed: Mar. 23, 1993

[30] Foreign Application Priority Data

Mar. 26, 1992 [EP] European Pat. Off. ..... 92105184.3

[51] Int. Cl.[6] ..... A44C 17/02
[52] U.S. Cl. ..... 63/28
[58] Field of Search ..... 63/26, 28

[56] References Cited

U.S. PATENT DOCUMENTS

| | | | |
|---|---|---|---|
| D. 114,649 | 5/1939 | Simon | 63/28 |
| 755,654 | 3/1904 | Guild | 63/28 |
| 1,440,229 | 12/1922 | Mestekin . | |
| 4,292,818 | 10/1981 | Vitau | 63/28 |
| 4,731,913 | 3/1988 | Plantureux | 63/28 |
| 4,761,865 | 8/1988 | Magnien et al. | 63/28 |
| 5,099,660 | 3/1992 | Dostourian | 63/28 |

FOREIGN PATENT DOCUMENTS

| | | |
|---|---|---|
| 0197871 | 10/1986 | European Pat. Off. . |
| 0233831 | 8/1987 | European Pat. Off. . |
| 837495 | 2/1939 | France . |

*Primary Examiner*—Michael J. Milano
*Attorney, Agent, or Firm*—Herbert Dubno

[57] ABSTRACT

Gem settings for jewelry pieces made from noble metals for gems to be set over larger areas in coherent arrangement into large-top bodies wherein a plurality of small stones having a round top-view configuration, being of larger and relatively smaller diameters and having a downwardly extending pointed end and a sharp peripheral edge are disposed in the top of the metal jewelry piece body snugly side by side in funnel-shaped setting recesses whose coordinates have been exactly predetermined and which are disposed in relatively staggered longitudinal rows while leaving gaps of minimum size to provide the prongs needed for setting the larger-size stones, the recesses for the smaller gems being of greater depth so as to make the larger-size gems overlap the smaller stones after insertion. For stones having a round contour, the gem setting gives a 95% area coverage so that the impression of a fully coherent array of gems is created.

6 Claims, 5 Drawing Sheets

FIG. 2
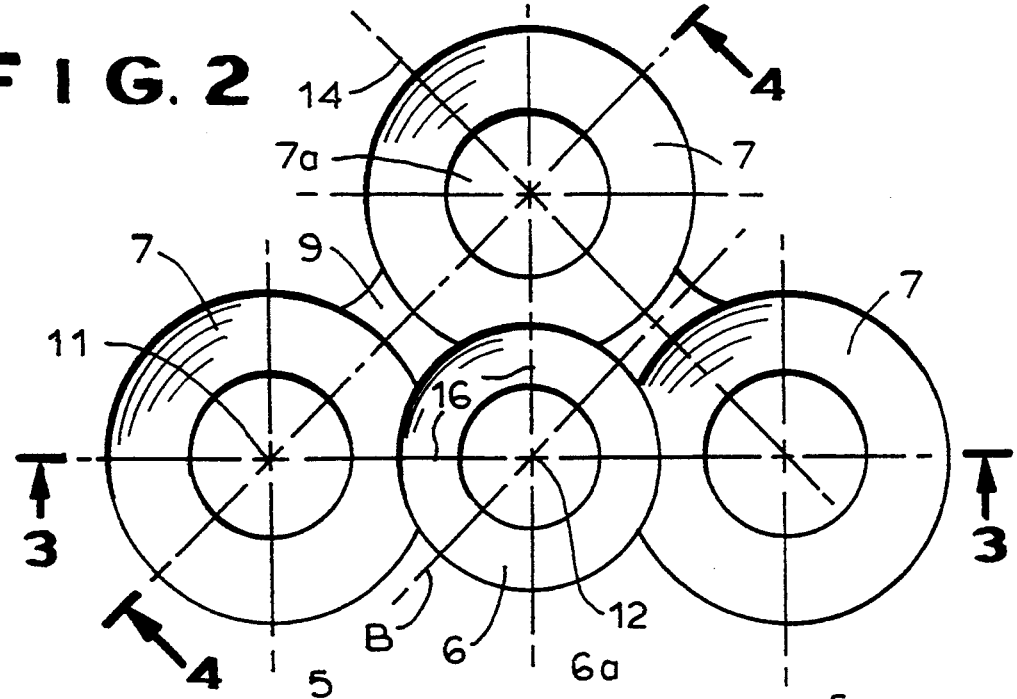
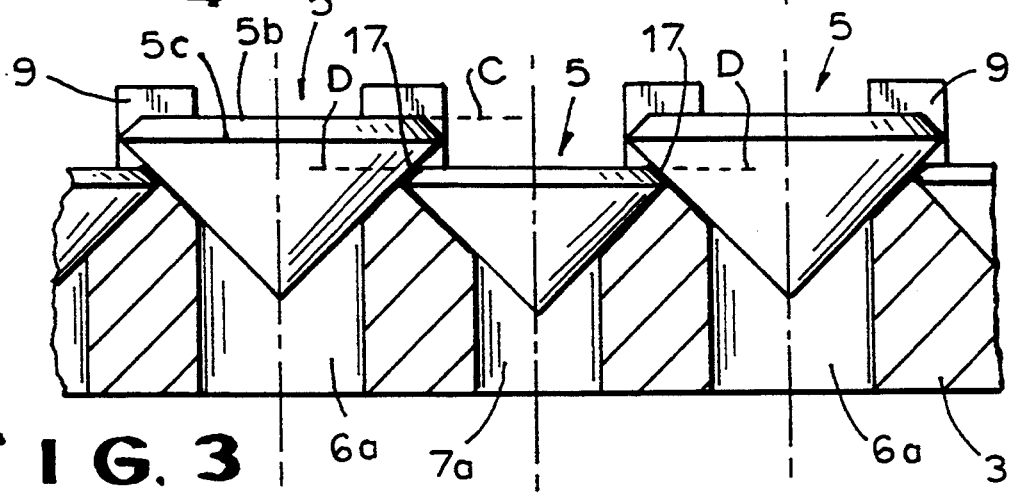
FIG. 3
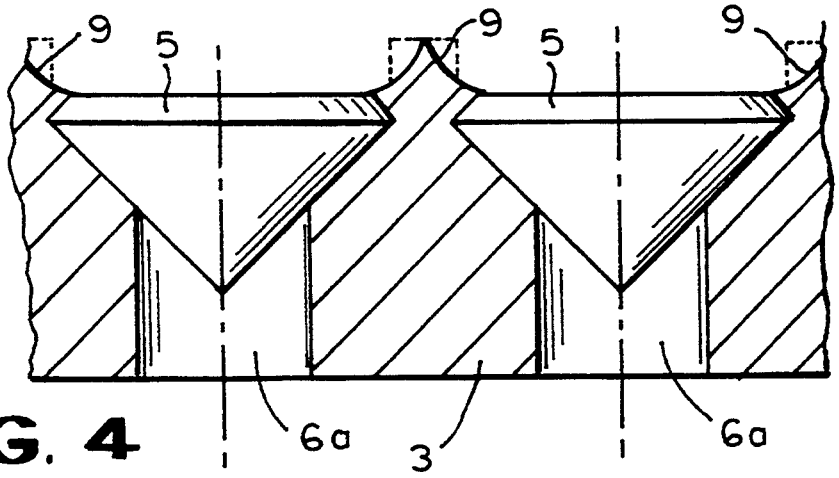
FIG. 4

GEM SETTING

FIELD OF THE INVENTION

This invention relates to gem settings for jewelry made from noble metals for gems to be set over larger areas into large top bodies in a coherent arrangement wherein a plurality of small stones having a round top-view configuration with a downwardly extending pointed end and a sharp peripheral edge are disposed in the top of the metal jewelry piece body snugly side by side, wherein the pointed ends of the gems are each inserted into corresponding open-bottom funnel-shaped setting recesses milled into the solid metal of the piece body, and wherein after insertion the gems are held by prongs or the like which have been formed intermediately of the funnel-shaped setting recesses.

BACKGROUND OF THE INVENTION

Gem settings of the type above described are known in the art. Their purpose is to place smaller gems or stones into a jewelry piece in a linear pattern and snugly side by side in such a way that a substantially coherent and preferably rectangular array of gems is provided wherein the size and number of stone-holding means generally consisting of holding cramps, prongs or the like which are made of metal and distributed over the periphery of the stones should be kept to the absolute minimum in order not to affect the appearance of the finished piece of jewelry.

According to one prior known technique (Payee) it is a customary practice, for instance when setting brilliants for bangles and finger-rings or the like, to mill recesses into the surface of the piece body arbitrarily, though with care taken to ensure that adequate spacings are provided between the stones because to set them it is necessary to manually provide holding cramps or the like out of the solid metal of the piece with the aid of a graver.

Consequently, this method results in gaps of relatively large size between the stones which are not filled by brilliants or the like. In addition, manual provision of the holding means is a very time-wasting and inaccurate process, since the solid metal of the piece body must be cut around the stones to provide the chips needed for holding the stones. These chips are finally bent over using a special tool to thereby provide the gem settings.

This technique requires adequate body metal to be left standing between the stones in any case, even where gems of small size are involved because the goldsmith needs ample space to provide the holders the way as described. It may therefore happen when adopting this method that the proportion of body metal predominates over that of the gems so that no optically coherent array of gems is achieved, but rather the appearance is that of an assembly of small individual stones.

Another prior-art technique (Pineapple) provides for the stone receiving recesses (bearings) to be manually drilled into the body metal of the piece at closest relative spacings. Pins, prongs, holding cramps or the like are manually soldered to the top of the piece within the area of the gaps thus formed, and beaded after the stones have been inserted to thereby provide the necessary setting for the gems.

This method requires for a very large number of prongs or pins to be soldered in a very wearisome manual process. The size of the stones used must not be less than a defined minimum since otherwise the pin area (prong area) would get disproportionately large over the gem area.

This prior art method involves a great deal of manual work. The stones are manually fitted at random in the absence of any calculation so that inaccuracies are provoked which have an adverse influence on the overall appearance of the finished piece of jewelry.

To achieve a coherent array of gems in a jewelry piece, therefore, it has become a customary practice to use stones having a square contour and substantially the shape of a pyramid with a square base adjoined by a square sharp peripheral edge. The stones are snugly placed in shallow recesses provided in the piece body whose bottom is a grid of bars crossing at right angles. The square recesses of said grid are each dimensionsed such that they are adapted to receive the pyramidal stone end and that following placement the stones are abutting each other by their straight peripheral edges. The gem sides are provided with an allround groove or notch into which the metal of the bars will be swaged after fitting the stones to thereby provide these with the necessary setting. Stones disposed along the marginal edge of the recess will be set or secured by beading the outer "walls" to said sharp peripheral edges.

This method, called Invisible Setting Technique, is only suitable for stones having a square contour, but the preparation of such stones is very expensive which also applies specifically to the setting of such gems that requires exceptional skill which is very difficult to acquire.

The Invisible Setting Technique calls for use of relatively large-sized and hence expensive gems because stones having a defined minimum size only can be handled in this complex and difficult method. The required square shape of the stones to be provided for the so-called Princess Cut Method requires more underbody and hence more expensive diamond material also while a round gem (brilliant) calls for a lesser amount of said material to be available.

To set square gems in that prior-art method is very complicated since forcing the setting metal into the stone grooves or notches is a very difficult and wearisome process.

When this prior-known technique is to be adopted for setting gems into rings which have a cambered top and a trapezoidal shape as seen in narrow-side view, for instance, then the stones cannot be set while still having their original square shape any longer, but rather have to be separately and specifically adapted to the configuration of the respective jewelry piece as from case to case required.

Moreover, since the square gems are disposed snugly and in one level when using the Invisible Setting Technique, it is impossible to check on completion of the job on whether the settings have been provided correctly.

OBJECT OF THE INVENTION

It is the object of the present invention to improve the initially mentioned gem setting such as to simplify and rationalize the process of providing closed-face gem settings while at the same time enabling a representative and creative implementation of a substantially coherent array of gems.

BRIEF DESCRIPTION OF THE DRAWING

According to the invention this object is achieved by providing a gem setting wherein the gem-receiving funnel-shaped recesses for stones having a defined size are disposed in longitudinal rows in the top of the piece body after precise measurements to determine the positions thereof while at the same time providing lateral spacings from the marginal edge of the piece and providing close relative spacings between said recesses, wherein as viewed across the body those funnel-shaped setting recesses that are of equal size at least are arranged side by side such that the centers thereof are precisely disposed on an imaginary connecting line extending at right angles to the longitudinal centerline of the piece. While leaving an amount of residual metal as needed to provide the prongs for setting the larger-size stones a plurality of funnel-shaped recesses adapted to receive gems of smaller volume are after corresponding measurements so arranged each in the points of intersection between the fictitious connecting lines and the centers of the recesses for the surrounding four larger-size gems through which they extend, in a plurality of other longitudinal rows staggered in relation to said primary rows, that they slightly overlap the recesses by which they are surrounded for said larger-size stones and are of greater depth than said latter to thereby ensure that the larger-size stones partly overlap the adjacent stones of smaller size after insertion. The metal projections formed by the gaps left vacant are forming the prongs for setting the larger-size stones after swaging along their sharp peripheral edges on placement.

Other than in any of the prior art setting techniques, the method according to this present invention does not involve any arbitrary drilling of individual funnel-shaped recesses into the metal of the piece body such as a ring nor any arbitrary provision of holding cramps, prongs or such like. The setting technique of this invention rather permits the gem positions to be exactly calculated by their coordinates which can be done by computer. The use of a computer-controlled dividing device with attached drilling or milling unit permits to provide the funnel-shaped setting recesses receiving the pointed ends of the gems in the primary and/or the staggered intermediate rows exactly and quickly just by milling the top of the jewelry piece. Their arrangement is not just haphazard any longer.

Figure 1:
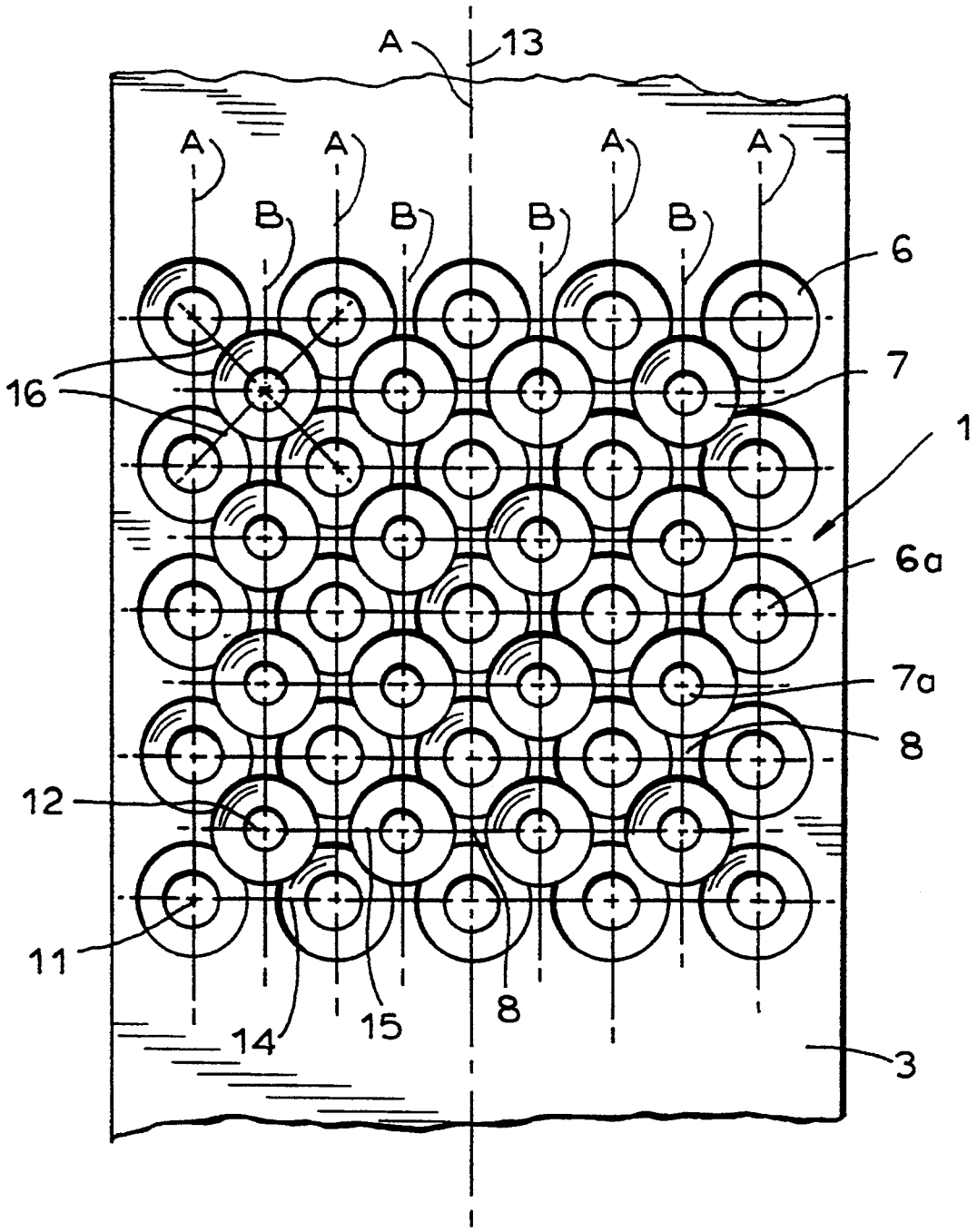

It is due to this mechanical dividing that the body metal left between the funnel-shaped recesses also is always exact and adequate in arrangement and size to thereby ensure that the amount of metal available for securing the stones is neither excessive nor inferior, but always uniform, so that it is possible to restrict oneself to the very minimum quantity that is just sufficient still to achieve the desired result.

The diameter of the smaller stones in the lower level will be determined on the assumption that the prongs need to have an edge length of about 0.6 mm to provide a safe setting, and in particular results from the distance of the longitudinal centerlines of the larger-size gems less the required prong or pin length of about 0.6 mm. In case of a larger-size stone, for instance, the diameter is 2 mm and the prong width about 0.4 mm. The diameter of the smaller-size stones results from the difference between 2.4 mm and 0.6 mm (prong length) so that each of the smaller stones should have a diameter of about 1.8 mm. The dimensions of the funnel-shaped recesses, too, can be derived from these figures.

It goes without saying that depending on the skill of the goldsmith or setter doing the job the actual length and width dimensions of the prongs may even be less than above stated (0.6 and/or 0.4 mm) which means that even a prong width of just 0.35 mm, for instance, may be sufficient.

The gem setting according to this present invention can be provided considerably faster, cheaper and more exact than random dividing by the eye and subsequent provision of the holding prongs between the stone-receiving recesses by soldering or with a graving tool would ever permit. The manual work that the gem setting method of this present invention still requires is restricted to just beading the body-metal for setting the stones.

The exceptional design advantage afforded by the gem setting technique of this invention resides in that due to precise utilization of all interstices or gaps in the piece body and partial relative overlapping of the stones owing to arrangement thereof in different levels as well as minimization of the number of visible prongs there is an optically coherent array of gems provided even where stones having a round contour are involved such that the percentage area of visible piece metal for holding prongs or such like between the stones is kept down to a minimum to thereby give the gems the very pleasant and attractive appearance that they should have.

Even though there has since long been a demand and need for a simplified, more economical and more precise technique for setting round gems in freestyle jewelry of any kind to provide gem arrays or patterns of substantial optical coherence in which the proportionate area of visible piece metal needed to form holding prongs or such like between the stones is kept to a minimum, those skilled in the art have heretofore not succeeded in creating a solution to that problem. To the goldsmith, therefore, the present invention provides an approach which permits to make jewelry of advanced design without impairing the hold of the stones and which moreover offers the advantage of particularly simple and economic manufacture because computer-controlled machines can be used in that process.

The advantage that the gem setting technique of this present invention offers over the Invisible Setting Method primarily resides in the fact that a substantially coherent array of gems can be produced at considerably lower cost, reason being on the one hand that round stones (brilliants) requiring less gem material while producing equal effects can be used in two different levels, and that on the other hand the coordinates of the stone-receiving funnel-shaped recesses can be assessed by computer and machined into the jewelry piece metal exactly and precisely by means of computer-controlled machines. Needless to say that the positions and dimensions of funnel-shaped recesses and prongs, too, can be simply determined by conventional methods and also without computers.

The setting proper of the stones does not require any complex techniques like the Invisible Setting Method. The technique according to this present invention rather provides for the setting operation to be done from above and visually by making cramps (prongs) as well as by beading and swaging said embracing prongs over the stones to thereby enable the prong type settings to be subsequently checked for workmanship also. Any manual fitting of separate and/or individual stones into jewelry pieces having random geometrical configurations is no longer required.

The prior-art techniques (Pavee and Pineapple) for setting gems having a round shape as seen in top view fail to predetermine position, size and depth of the funnel-shaped recesses. In addition, the holding prongs used in these methods are different: while according to the Payee Technique the prongs are handmade and easily tend to break off, those used in the Pineapple method are soldered to the metal of the piece body. To make sure that the proportionate area of prong material be not predominant, therefore, the stones used to these methods are to have a defined minimum size at any rate.

Another advantage over the Invisible Setting Technique which requires gems that are square as seen in top view is especially residing in the fact also that the stones needed to cover an equal-size area with gems in a substantially coherent pattern as per the present invention is less expensive.

Last, but not least, is the gem setting of this invention offers the further advantage that due to the closer-spaced arrangement of the stones said latter (for instance brilliants) produce an essentially better light reflection effect (brilliance).

Finally, the invention permits setting even of smallest stones snugly and side by side in different levels such as to create a pleasant and attractive appearance.

The prongs can be arranged so as to hold the larger sized stones in four positions after swaging of which two each are diametrically opposed. Each of the stones displayed in the outer border line area of the array of gems can be set by beads provided from the solid surrounding metal of the jewelry piece body.

One advantageous embodiment of this invention provides that for strip bodies of identical overall width and with flat tops the funnel-shaped recesses for the larger-size stones are of identical diameter and while leaving small, though equal-sized relative gaps are disposed in parallel longitudinal rows in the top of the strip body such that as viewed across said body their centers are each disposed on a connecting line extending at right angles to the longitudinal centerline of the body and that the funnel-shaped recesses in the longitudinal rows staggered relatively thereto to receive the smaller stones are also of equal size and as viewed across the body have their centers disposed on a connecting line that extends at right angles to the longitudinal centerline of said body.

Another advantageous embodiment of the invention provides that the funnel-shaped recesses to receive the larger-size gems and the funnel-shaped recesses staggered in relation thereto for receiving the smaller stones are in the case of strip bodies with a trapezoid contour as seen in narrow-side view and a cambered top are disposed in longitudinal rows which are slightly and uniformly diverging towards the apex of the strip body and that both the larger-size gems and the smaller stones arranged in longitudinal rows staggered relatively thereto are gradually increasing in size towards said apex, with the metal left to provide the prongs as well gradually increasing in volume towards said apex in the same proportion and that the funnel-shaped setting recesses arranged side by side transversally across the body both for the larger and the smaller-size stones and the prongs adjacently disposed in rows also are of relatively equal size each.

The method according to the present invention not only provides jewelry from flat annular strip bodies of uniform width with coherent arrays of gems, but also can be used for any freestyle shapes and/or strip bodies having a cambered surface and increasing in width towards their apex the way as encountered in the case of bangles and finger-rings. This requires redetermining the funnel-shaped setting recesses from one transversal row to the next the way as proposed according to the invention, since stones of different size are used in the various longitudinal rows to create a properly proportioned coherent array of gems.

It is expedient, therefore, to gradually increase the size of the stones by a defined amount towards the larger-width apex of the piece, for instance a ring, the calculations required for which purpose can be established both conventionally and with the aid of a computer. In that case, too, the invention provides for the funnel-shaped setting recesses to be advantageously disposed in different levels so that the stones in the various longitudinal rows alternatingly overlap each other to thereby provide an array of gems which is fully coherent with the exception of the minimum area needed for the prongs and which is featured by extraordinary brilliance.

BRIEF DESCRIPTION OF THE DRAWING

Figure 5:
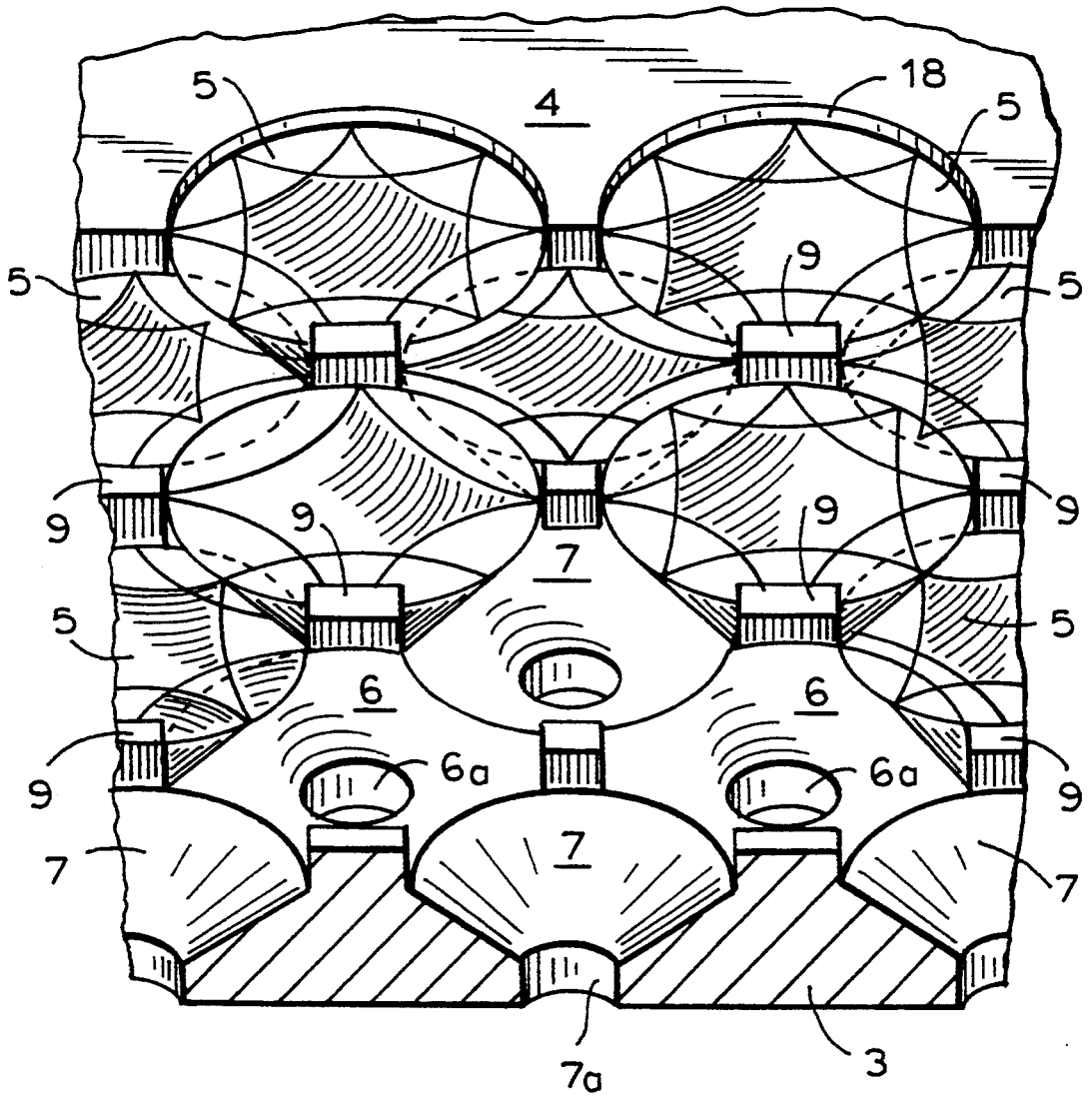
Figure 6:
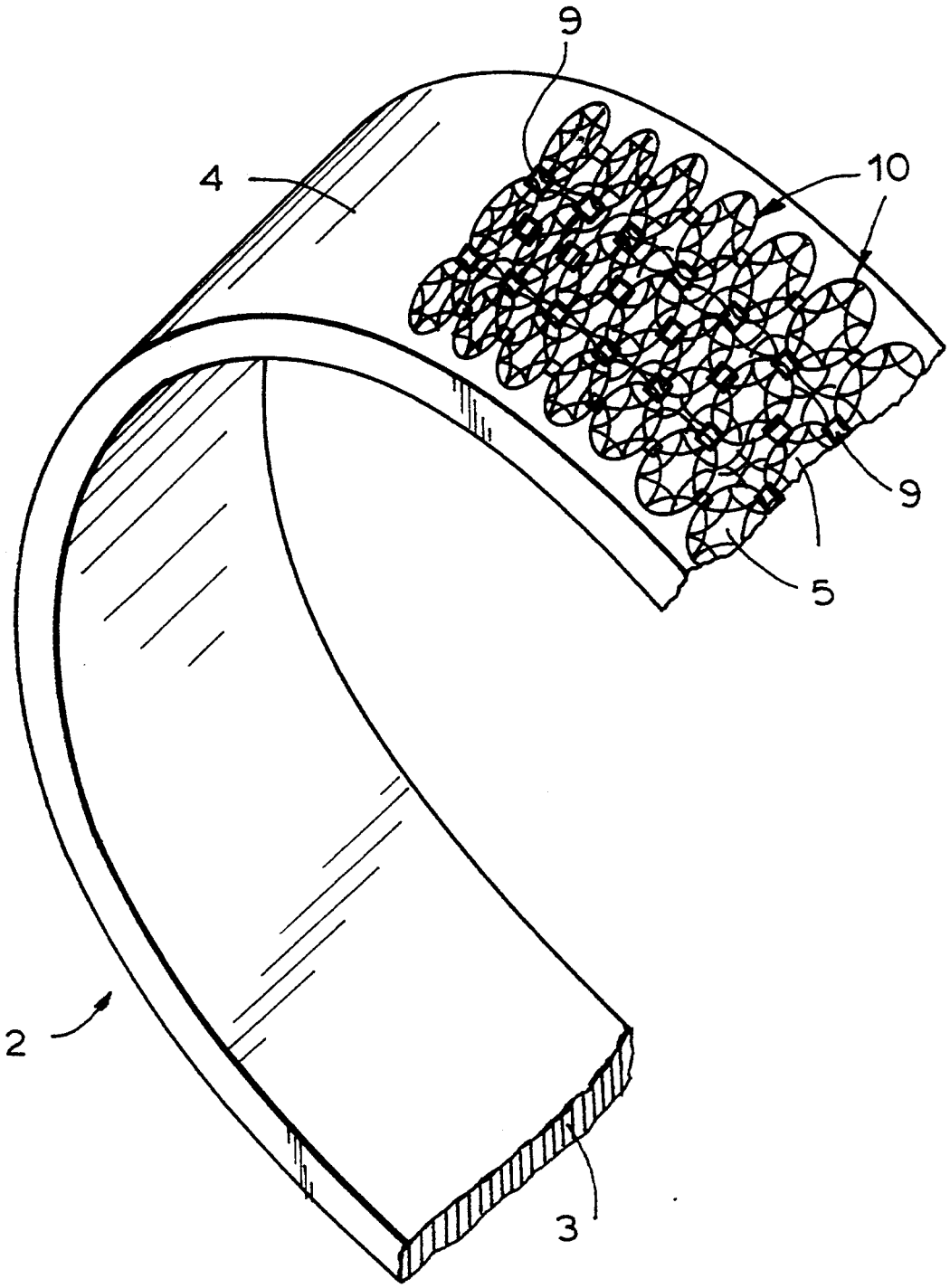
Figure 7:
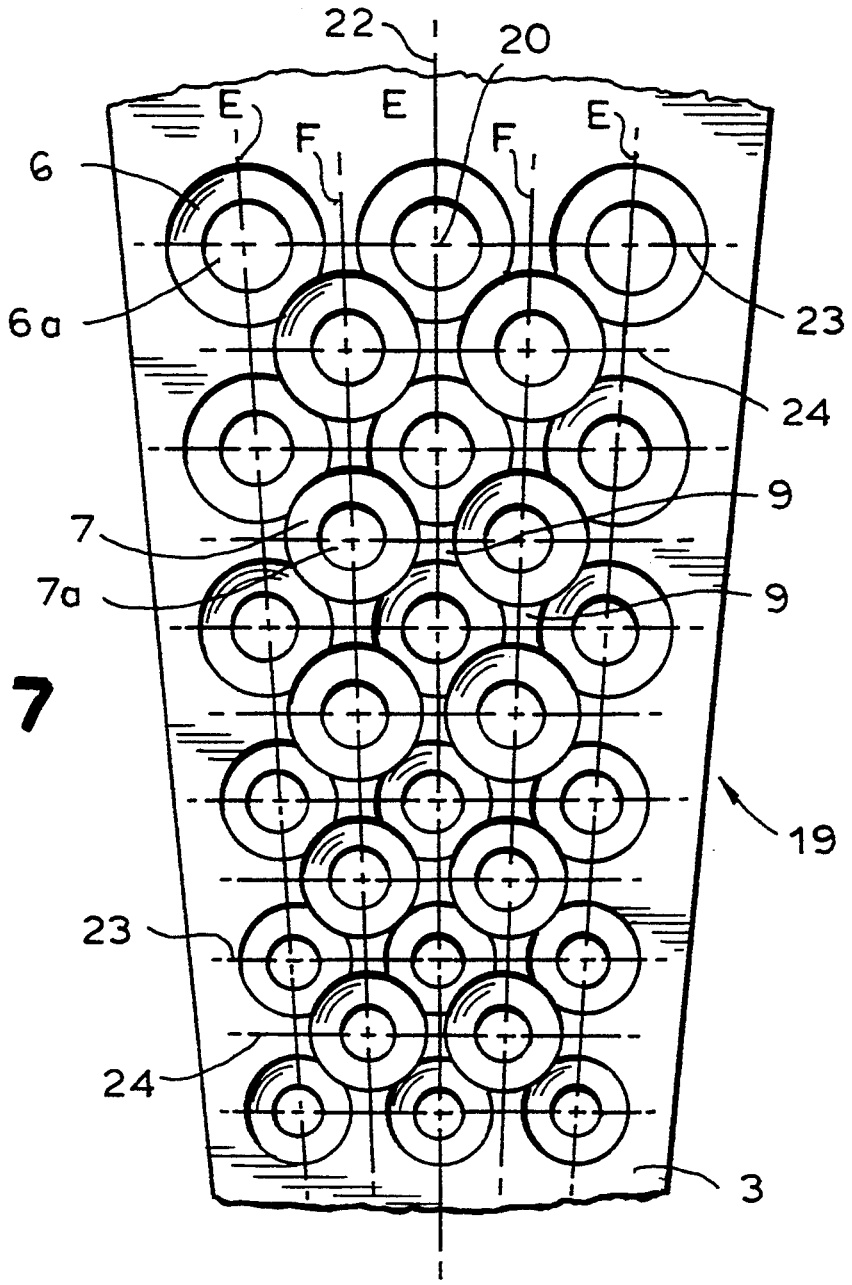
Figure 8:
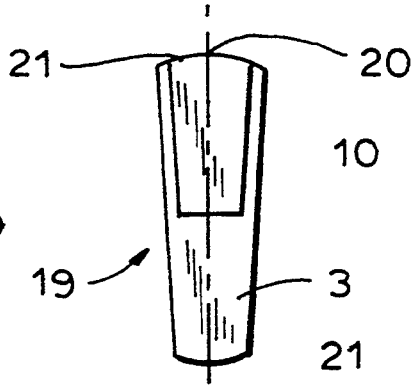

The above and other objects, features, and advantages will become more readily apparent from the following description, reference being made to the accompanying drawing in which:

FIG. 1 is a schematic partial developed view drawn to larger scale of a gem setting according to the present invention for a finger-ring of uniform width and with flat top as viewed against the funnel-shaped setting recesses, the larger and the smaller recesses each being of equal size, with no stones fitted;

FIG. 2 is a partial top view drawn to larger scale of a finger-ring gem setting according to the invention same as in FIG. 1, with no stones fitted;

FIG. 3 is a partial section drawn to larger scale through the finger-ring as per FIG. 2 and the gem setting of the present invention, with gems or stones fitted in place, along section line III—III in FIG. 2 wherein the prongs to set the stones are still in unswaged condition;

FIG. 4 is a partial section drawn to larger scale through the finger-ring along section line IV—IV in FIG. 2 with stones set by swaged prongs and showing the preswage shape of the prongs in dashline representation;

FIG. 5 is a fragmentary perspective view drawn to larger scale of an array of gems set according to the present invention on a finger-ring as per FIGS. 1 to 4 which shows funnel-shaped setting recesses in part provided with stones;

FIG. 6 is a fragmentary perspective view drawn to larger scale of a finger-ring with an array of gems set in accordance with this present invention, the body of the ring being of uniform width throughout and the ring body having a flat top;

FIG. 7 is a schematic partial developed view drawn to larger scale of a finger-ring gem setting according to the present invention, the strip body of said ring gradually increasing in width towards its apex and having a cambered top and/or surface, with no stones fitted, in top view; and FIG. 8 is a side-elevational view drawn to smaller scale of a finger-ring with a metal body gradually increasing in width towards its apex and with a cambered surface as shown in FIG. 7.

SPECIFIC DESCRIPTION

The gem setting 1 of the present invention is illustrated in greater detail in the drawing (FIGS. 1 to 6)

with reference to a finger-ring 2 having a strip body 3 of uniform width throughout and a flat top 4. It is intended to provide a substantially coherent array of gems 10 consisting of a large number of small-size round stones 5 (for instance brilliants) each having a pointed end 5*a*, a flat top 5*b* and a sharp peripheral edge 5*c*.

The positions of individual funnel-shaped recesses 6 and/or 7 for the gem setting 1 of this present invention are determined by calculation with consideration to leaving lateral, edge-parallel spacings, and milled into the solid metal of the strip body 3 (a finger-ring in this case) by means of a drilling or milling unit. The funnel-shaped setting recesses 6 and 7 are provided with throughholes 6*a* and/or 7*a* which produce an improved light reflection effect from the gems 5 (brilliants) after setting thereof.

The gem setting 1 of the present invention consists of an area surrounded by metal of the strip body 3 on all sides which area comprises longitudinal rows A and/or B into which funnel-shaped setting recesses 6 and/or 7 are machined while leaving gaps 8 of a defined minimum width and length for the prongs 9, each second longitudinal row B comprising funnel-shaped recesses 7 of smaller size and greater depth which are disposed at uniform staggers relative to the funnel-shaped setting recesses 6 of adjacent longitudinal rows A with exact symmetrical utilization of said gaps 8 and which partly overlap the funnel-shaped recesses 6 surrounding them of the other longitudinal rows A.

In this way it is possible to arrange the stones 5 of longitudinal rows A and/or B in two different levels C and D while partly overlapping each other. Only the minimum metal of the prongs 9 needed to set the upper stones 5 of longitudinal rows A is exposed and/or visible so that an array of gems 10 of substantial optical coherence is provided.

In the exemplified embodiment as per FIGS. 1 to 6 the funnel-shaped recesses 6 for the larger-size gems and the recesses 7 for the smaller-size stones each are of identical size and are disposed in relatively parallel longitudinal rows A and B in the top of the strip body or piece 3. Their centers 11 and 12 are each disposed on a connecting line 14 and/or 15 that extends at right angles to the longitudinal centerline 13 of said body as viewed transversally across the strip body 3. The centers 12 of the funnel-shaped recesses 7 for the smaller stones 5 as arranged in the staggered longitudinal rows B each are disposed in the points of intersection between the fictitious connecting lines 16 and the centers 11 of the funnel-shaped recesses 6 for the surrounding four larger-size gems 5 through which they are extending.

The stones or gems 5 of smaller diameter are being held by a bead 17 which has been formed from body metal that slightly protruded over the sharp peripheral edges of the stones. The larger-diameter gems 5 disposed along the outer marginal area 10 in longitudinal rows A are set by a bead 18 formed from the adjacent solid metal of the strip body, purpose for which the depth of the funnel-shaped setting recesses 6 is dimensioned such that the surrounding marginal edge thereof slightly protrudes over the sharp peripheral edge 5*c* of the larger-size stones 5 after insertion thereof.

A gem setting 1 as per this present invention is provided as follows:

The first step is to calculate the ring circumference, followed by determination of the pitches for instance by conventional methods using a dividing tool, based on the diameter of the stones 5 in longitudinal rows A and the thickness of the prongs 9. On this, the previously assessed coordinates for the funnel-shaped setting recesses 6 will be centered by means of a combination unit consisting of a dividing device known per se and a per se known drilling machine (not shown in the drawing). This is followed by drilling the funnel-shaped recesses 6 for the stones 5 in longitudinal rows A whose diameters are derived from the calculated size of the gems in each case.

The next step is to drill and/or mill the funnel-shaped setting recesses 7 for the stones 5 of longitudinal rows B. Said recesses 7 to receive the stones in longitudinal rows B are disposed about 2/10 mm lower than the recesses 6 for the stones of longitudinal rows A to make sure that the sharp peripheral edges 5*c* of the stones 5 in said longitudinal rows B get arranged below the peripheral edges of said stones 5 in longitudinal rows A.

All that will be left from the original surface of strip body 3 after completed milling thereof are the prongs 9 needed for setting whose area is still figuring between 3 and 5% only of the total face 10 to be covered with stones. The width of the marginal area aside said surface 10 on the strip body is at discretion.

This system permits to obtain a so far never achieved surface coverage of 95% when using round stones compared to a coverage of about 70% according to the Pavee Technique.

The setter then initially sets the stones 5 of longitudinal row B by forming a bead 17 from the projecting edges of the funnel-shaped setting recesses 6 for the stones in longitudinal rows B. Since the recesses 6 for these stones are by about 2/10 mm lower as stated before, an edge is provided which permits to fix the stones 5 of longitudinal row B to make sure these will not jump out when setting the larger-size gems 5 of longitudinal rows A.

After all stones in longitudinal rows B have been fixed, the setting proper of the stones 5 of longitudinal rows A will commence by swaging the leftover prongs 9.

It is due to the overlapping condition of the stones that the fixings of gems 5 in longitudinal rows B are no longer visible. Only the swaged prongs 9 of the upper layer still are exposed. This creates a substantially closed pattern and/or coherent array of gems 10 wherein the upper stones 5 of longitudinal rows A are visible entirely while in the gaps the tops 5*b* of the stones 5 in longitudinal rows B only are exposed.

The final stones 5 must be chased against the last prong or pin 9 in conventional manner (bead 18). This requires the stone edges to be disposed a little beneath the metal of the strip body 3 which is so at the lateral transversal and longitudinal boundaries of strip body 3.

FIGS. 7 and 8 show another potential embodiment of a gem setting 1 according to this invention for a finger-ring 19 whose strip body 3 gradually increases in width towards its apex and which has a cambered top 21.

As can be seen from these figures, the stones 5 and/or their funnel-shaped setting recesses 6 and 7 are disposed in longitudinal rows E and/or F which are uniformly diverging consistent with the outer contour of the finger-ring, the central longitudinal row E being arranged parallel to the fictitious longitudinal centerline 22 of said ring 19.

To create a pleasant and attractive appearance, the stones 5 and of course also their funnel-shaped setting recesses 6 and/or 7 gradually increase in size by a defined amount towards the apex 20 of the finger-ring 19. The same applies to the metal left standing to provide the prongs 9.

Viewed in transversal direction, the stones and/or their funnel-shaped setting recesses 6 and 7 disposed on a connecting line 23 and/or 24 that extends at right angles to the longitudinal centerline 22 of the ring 19 are of identical size which also applies to the metal left standing to provide the prongs 19.

It will be understood that the scope of this invention is not restricted to the exemplified embodiments described herein-before and illustrated in the figures as they just represent advantageous forms of implementation of the inventive concept.

The scope of protection of the invention not only covers the features of the individual claims, but also any combination thereof.

Any and all individual or combination features disclosed in the claims, the specification and/or the figures of the drawing are regarded as being essential to the invention.

I claim:

1. A gem setting for a jewelry piece made from noble metals for gems to be set over large areas into large-top bodies in a coherent arrangement in which a plurality of small stones having a round top-view configuration with a downwardly extending pointed end and a sharp peripheral edge are disposed in the top of the metal jewelry piece body snugly side by side, in which the pointed ends of the gems are each inserted into corresponding open-bottom funnel-shaped setting recesses milled into the solid metal of the piece body, and in which after insertion the gems are held by prongs or such like which have been formed intermediately of said funnel-shaped recesses, said setting being formed with the gem-receiving funnel-shaped recesses in primary longitudinal rows in the top of the piece body after precise measurements to determine the positions thereof while at the same time providing lateral spacings from the marginal edge of the piece and body with close relative spacings between said recesses wherein as viewed across the body those funnel-shaped recesses that are of identical size at least are arranged side by side such that centers thereof are precisely disposed along an imaginary connecting line extending at a right angle to a longitudinal centerline of the piece body; an amount of residual metal being left as needed to provide prongs for setting larger-size stones, while a plurality of said funnel-shaped setting recesses receive gems of smaller volume are disposed each at points of intersection between the imaginary connecting lines for surrounding larger-size gems through which they extend, in a plurality of other rows staggered in relation to said primary rows, that they slightly overlap the recesses for said larger-size stones and are of greater depth than the recesses for the larger-size stones to thereby ensure that the larger-size stones partly overlap the adjacent stones of smaller size after insertion; and said being swaged for setting the larger-size stones along their sharp peripheral edges on placement.

2. The gem setting defined in claim 1 wherein the prongs are arranged so as to hold the larger-size stones in four positions after swaging of which two each are diametrically opposed.

3. The gem setting as defined in claim 1 wherein each of the stones disposed in an outer border-line area of the array of gems are set by beads provided from the solid surrounding metal of the jewelry piece body.

4. The gem setting defined in claim 1 wherein the smaller-diameter stones are held by a bead consisting of body metal chased to slightly protrude over the sharp peripheral edges of the gems.

5. The gem setting defined in claim 1 wherein, for strip bodies of identical overall width and with flat tops, the funnel-shaped setting recesses for the larger size stones are of identical diameter and while leaving small, equal-size relative gaps are disposed in parallel longitudinal rows in the top of the strip body such that as viewed across said body their centers are each disposed on a connecting line extending at right angles to the longitudinal centerline of the strip body and that the funnel-shaped recesses in the longitudinal rows staggered relatively thereto to receive the smaller stones are also of equal size and as viewed across the strip body have their centers disposed on a connecting line that extends at right angles to the longitudinal centerline of said strip body.

6. The gem setting defined in claim 2 wherein the funnel-shaped setting recesses to receive the larger-size gems and the funnel-shaped recesses staggered in relation thereto for receiving the smaller stones are in the case of strip bodies with a trapezoid contour as seen in narrow-side view and a cambered top are disposed in longitudinal rows which are slightly and uniformly diverging towards the apex of the strip body and that both the larger-size gems and the smaller stones arranged in longitudinal rows relatively staggered thereto are gradually increasing in size towards the apex of said strip body, with the metal left to provide the prongs increasing as well in volume towards said apex of the strip body in the same proportion, and that the funnel-shaped setting recesses arranged side by side transversely across the strip body for both the larger and the smaller-size stones and the prongs adjacently disposed in rows also are of relatively equal size each.

* * * * *